US009121104B2

(12) United States Patent
Tessier et al.

(10) Patent No.: US 9,121,104 B2
(45) Date of Patent: Sep. 1, 2015

(54) SYSTEMS AND METHODS FOR DETERMINING ALUMINA PROPERTIES

(75) Inventors: Jayson Tessier, Cap Sante (CA); Gary P. Tarcy, Murrysville, PA (US); Eliezer Batista, Pittsburgh, PA (US); Xiangwen Wang, Murrysville, PA (US)

(73) Assignee: Alcoa Inc., Pittsburgh, PA (US)

( * ) Notice: Subject to any disclaimer, the term of this patent is extended or adjusted under 35 U.S.C. 154(b) by 1055 days.

(21) Appl. No.: 13/017,557

(22) Filed: Jan. 31, 2011

(65) Prior Publication Data

US 2012/0197542 A1 Aug. 2, 2012

(51) Int. Cl.
*C25C 3/20* (2006.01)
*C25C 3/14* (2006.01)

(52) U.S. Cl.
CPC .... *C25C 3/20* (2013.01); *C25C 3/14* (2013.01)

(58) Field of Classification Search
USPC ..... 702/25, 30, 31, 45, 50, 130, 182, 183, 702/23
See application file for complete search history.

(56) References Cited

U.S. PATENT DOCUMENTS

| | | | | |
|---|---|---|---|---|
| 5,154,907 | A * | 10/1992 | Kim et al. | 423/412 |
| 5,324,408 | A | 6/1994 | Kissane | 204/245 |
| 5,476,574 | A | 12/1995 | Welch et al. | 205/392 |
| 6,609,119 | B1 * | 8/2003 | Meghlaoui | 706/25 |
| 6,942,381 | B2 | 9/2005 | Hosler et al. | 374/139 |
| 7,731,824 | B2 | 6/2010 | Slaugenhaupt et al. | 204/247 |
| 2007/0143981 | A1 | 6/2007 | Bourges | |
| 2007/0295615 | A1 | 12/2007 | Wang et al. | 205/775 |
| 2009/0107840 | A1 | 4/2009 | Tessier et al. | 204/407 |
| 2010/0243460 | A1 | 9/2010 | Wang et al. | 205/82 |

FOREIGN PATENT DOCUMENTS

| | | | |
|---|---|---|---|
| CN | 1930060 | A | 3/2007 |
| CN | 101275249 | | 10/2008 |
| CN | 101868765 | A | 10/2010 |
| CN | 201634783 | | 11/2010 |
| WO | 93/14247 | | 7/1993 |
| WO | WO00/40781 | | 7/2000 |
| WO | 2009067019 | A1 | 5/2009 |

OTHER PUBLICATIONS

Dyroy, A. et al., "Effects of Segregation on the Environment and Yield in Aluminium Production," pp. 12, 14-15, The Postec Newsletter No. 20, available at www.tel-tek.no, Tel-Tek, Porsgrunn, Norway, Nov. 2001.

(Continued)

*Primary Examiner* — Mohamed Charioui
(74) *Attorney, Agent, or Firm* — Greenberg Traurig, LLP

(57) ABSTRACT

Systems, methods and apparatus relating to evaluation of alumina feedstocks are disclosed. A system may include an alumina storage unit comprising an alumina feedstock, an alumina supply member in communication with the alumina storage unit and an aluminum electrolysis cell. The alumina feedstock of the alumina storage unit may periodically flow through the alumina supply member and to the aluminum electrolysis cell. A measurement device may be in communication with the alumina supply member, and may be configured to measure a supply member property and transmit a first signal to a processor. The processor may be configured to receive the first signal and produce supply member property data based, at least in part, on the first signal.

20 Claims, 8 Drawing Sheets

(56) References Cited

OTHER PUBLICATIONS

Grjotheim, K., et al., *Introduction to Aluminium Eletrolysis: Understanding the Hall-Héroult Process*, 2nd Edition, Aluminium-Verlag, p. 67, 1993.

Kuschel, G. I., "The Effect of Alumina Properties and Smelter Operating Conditions on the Dissolution Behaviour of Alumina," Ph.D. Thesis, Dept. of Chemical and Materials Engineering, The University of Auckland, New Zealand, pp. 164-168, Mar. 1990.

Ose, S., et al., "Using Noise to Predict Particle Size and Segregation Online," p. 16, *The Postec Newsletter* No. 20, available at www.tel-tek.no, Tel-Tek, Porsgrunn, Norway, Nov. 2001.

Welch, B., et al., "Crust and alumina powder dissolution in aluminum smelting electrolytes," *JOM*, vol. 59, No. 5, pp. 50-54, May 2007.

Unpublished (non-publication request), commonly-owned U.S. Appl. No. 12/854,612 (Tarcy et al.), filed Aug. 11, 2010.

International Search Report and Written Opinion, Dated Aug. 27, 2012, from corresponding International Application No. PCT/US2012/023241.

English translation of Chinese Office Action in Chinese application No. 201280007079 dated Aug. 29, 2014.

* cited by examiner

SYSTEMS AND METHODS FOR DETERMINING ALUMINA PROPERTIES

BACKGROUND

Alumina is used as a feedstock in the production of aluminum metal in aluminum electrolysis cells. Alumina quality may vary, sometimes significantly, depending on supplier and/or grade, among other factors. This variance in alumina quality may impact operation of the aluminum electrolysis cells. One parameter that may vary is alumina flowability. For example, FIG. 1 illustrates the variability in alumina flowability for a single electrolysis cell over a one-year period. The flowability ranges from about 65 seconds to about 160 seconds. Flowability may also be highly variable from pot to pot. For example, as illustrated in Table 1, below, five different pots in the same smelter realized an average flowability of from 59 seconds to 152 seconds, even though the measurements were all conducted at about the same time.

TABLE 1

| Electrolysis Cell | Flowability (flow funnel time) |
|---|---|
| A | 109 |
| B | 152 |
| C | 118 |
| D | 87 |
| E | 59 |

SUMMARY OF THE DISCLOSURE

Broadly, the present application relates to systems and methods for determining one or more properties of an alumina feedstock. Those properties may be used to change the operating parameters of one or more aluminum electrolysis cells (e.g., in an effort to improve the performance of one or more aluminum electrolysis cells).

In one aspect, a system includes an alumina storage unit containing, or adapted to contain, an alumina feedstock. The system may include an alumina supply member in communication with the alumina storage unit. The alumina supply member may also be in communication with an aluminum electrolysis cell. For example, the alumina supply member may include a passageway having a distal end portion, a proximal end portion and a middle portion. The distal end portion may be in communication with the alumina storage unit. The proximal end portion may be in communication with the aluminum electrolysis cell. The middle portion is disposed between the distal end portion and the proximal end portion. The alumina feedstock of the alumina storage unit may periodically flow through the alumina supply member (e.g., via the passageway) and to the aluminum electrolysis cell. A measurement device may be in communication with the alumina supply member. The measurement device may be configured to measure a supply member property (e.g., alumina feedstock temperature) and transmit a first signal to a processor. The processor may be configured to receive the first signal and produce supply member property data (e.g., alumina feedstock temperature data) based, at least in part, on the first signal. This data may be used to predict an alumina property (e.g., alumina flowability). For example, the system may include a data analyzer configured to analyze the supply member property data and provide/output a predicted alumina property based on the supply member property data.

In one embodiment, the measurement device is a thermocouple. The thermocouple may be located proximal to, within and/or or adjacent the passageway of the alumina supply member. As alumina feedstock of the alumina supply flows through the passageway, the thermocouple may obtain temperature readings, which may be converted to temperature data via the processor. A data analyzer may receive the temperature data and correlate such data to a predicted alumina property (e.g., alumina flowability, alumina particle size distribution, including the average particle size, alumina feed rate and/or amount) using one or more models. The data analyzer may output the predicted alumina property, for example, to a display, a control device and/or other apparatus and/or systems. In turn, alumina flow parameters may be adjusted. A plurality of alumina storage units, alumina supply members, measurement devices, processors, and/or data analyzers may be used, as appropriate.

In one approach, an alumina flow control device (e.g., a valve) is in communication with the alumina storage unit and/or the alumina supply member. The alumina flow control device may be in communication with a controller (e.g., a computer; a PLC). The controller may adjust the alumina flow control device, based at least in part, on the predicted alumina property.

In one approach, an alumina supply member is configured to achieve a predetermined residence time of the alumina feedstock so as to facilitate measurement of the supply member property. In one embodiment, the predetermined residence time corresponds to a time interval adequate to obtain reliable temperature measurements. For example, a thermocouple may require at least one second of contact with the alumina feedstock to obtain reliable temperature measurements. In one embodiment, the predetermined residence time is at least about 2 seconds. In other embodiments, the predetermined residence time is at least about 2.5 seconds, or at least about 3 seconds, or at least about 3.5 seconds, about 4 seconds, or at least about 4.5 seconds, or more.

The predetermined residence time may also/alternatively be related to a time interval that is non-intrusive to alumina feed operations. For example, an aluminum electrolysis cell may require an alumina feed cycle (sometimes called a drop, shot, or dump) every 5 to 60 seconds. In this regard, in one embodiment, the predetermined residence time may be not greater than about 30 seconds. In other embodiments, the predetermined residence time may be not greater than about 25 seconds, or not greater than about 20 seconds, or not greater than about 15 seconds, or not greater than about 10 seconds, or not greater than about 9 seconds, or, not greater than about 8 seconds, or not greater than about 7 seconds, or not greater than about 6 seconds, or not greater than about 5 seconds, or less.

In one embodiment, the predetermined residence time is in the range of from about 1 second to about 30 seconds. In another embodiment, the predetermined residence time is in the range of from about 2 seconds to about 20 seconds. In one embodiment, the predetermined residence time is in the range of from about 2.5 seconds to about 10 seconds. In one embodiment, the predetermined residence time is in the range of from about 3 seconds to about 5 seconds. Other combinations of the above-described minimum and maximum predetermined residence time values may be employed, depending on alumina supply member and/or aluminum electrolysis cell requirements.

Relative to the predetermined residence time, the passageway of the alumina supply member may include a narrowing portion. For example, the middle portion may have a first diameter (or other length, if non-circular/non-oval), and the distal end portion may have a second diameter. In one embodiment, the first diameter is smaller than the second diameter. In one embodiment, the first diameter is sized to achieve the predetermined residence time range. The measurement device may be in communication with any suitable narrower portion of the passageway, such as the middle portion and/or proximal end portion of the alumina supply member. This may facilitate measurement of the supply member property.

In one embodiment, the first diameter is at least about 5 mm. In other embodiments, the first diameter is at least about 10 mm, or at least about 12 mm, or at least about 14 mm, or at least about 16 mm, or at least about 18 mm, or at least about 20 mm, or more.

In one embodiment, the first diameter is not greater than about 50 mm. In other embodiments, the first diameter is not greater than about 45 mm, or not greater than about 40 mm, or not greater than about 38 mm, or not greater than about 36 mm, or not greater than about 34 mm, or not greater than about 32 mm, or not greater than about 30 mm, or less.

In one embodiment, the first diameter has a size in the range of from about 5 mm to about 50 mm. In another embodiment, the first diameter has a size in the range of from about 10 mm to about 40 mm. In yet another embodiment, the first diameter has a size in the range of from about 15 mm to about 30 mm. Other combinations of the above-described minimum and maximum diameters may be employed, depending on alumina supply member and/or aluminum electrolysis cell requirements.

Methods of supplying alumina feedstock to an aluminum electrolysis cell are also provided. In one aspect, a method may include the steps of electrolytically producing aluminum metal in an aluminum electrolysis cell, flowing alumina feedstock through an alumina supply member that is in communication with the aluminum electrolysis cell, measuring (e.g., concomitant to the flowing step) at least one supply member property, producing supply member data based on the supply member property, and analyzing the supply member data, thereby determining characteristics of the alumina feedstock.

In one embodiment, the characteristic of the alumina feedstock at least includes alumina flowability. In these embodiments, a measurement device may measure a plurality of temperature measurements associated with the alumina supply member (e.g., the alumina feedstock temperature), such as during or concomitant to the flowing alumina feedstock step. In such embodiments, temperature data is produced from the temperature measurements, and such temperature data are correlated to a predicted alumina flowability (e.g., during the analyzing step). In one embodiment, the temperature data is compared to historical operational data, and a predicted alumina flowability may be output (e.g., using a model). The predicted alumina flowability may be compared to a target alumina flowability, after which it may be determined whether to complete a control response. In one embodiment, a method includes the step of adjusting one or more operation parameters associated with the flow of the alumina feedstock (e.g., in response to the comparing step; based on the determined characteristics of the alumina feedstock). In one embodiment, the analyzing step includes developing an alumina prediction model based, at least in part, on the supply member data. The analyzing step may include outputting at least one predicted alumina property utilizing the alumina prediction model.

These and other aspects, advantages, and novel features of the described technology are set forth in part in the description that follows and will become apparent to those skilled in the art upon examination of the following description and figures, or may be learned by practicing the described technology. Other variations, embodiments and features of the present disclosure will become evident from the following detailed description, drawings and claims.

Various ones of the above-described aspects, approaches and embodiments may be combined and/or substituted, as appropriate, to achieve various inventive systems, methods and apparatus for determining one or more properties of an alumina feedstock. Furthermore, the above-described systems may be utilized in conjunction with the above-described methods, and vice-versa, as appropriate, to achieve various inventive systems, methods and apparatus for determining one or more properties of an alumina feedstock.

DETAILED DESCRIPTION

Reference will now be made in detail to the accompanying drawings, which at least assist in illustrating various pertinent embodiments of the present invention.

Figure 1:
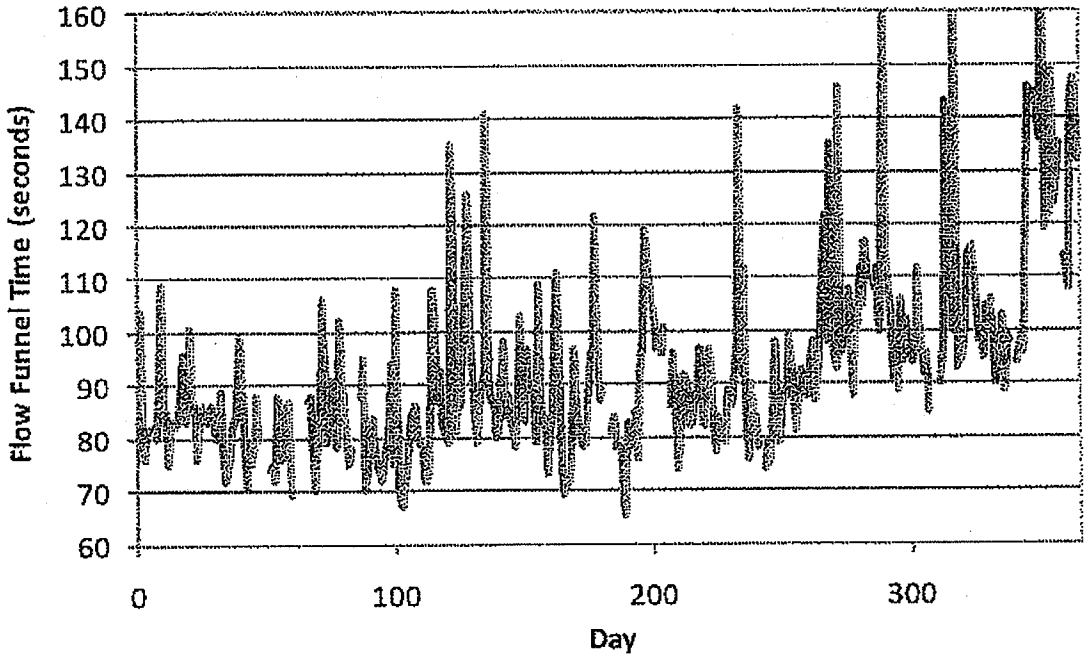
FIG. 1 is a graph illustrating the variability in alumina flowability for a single aluminum electrolysis cell over a one-year period.
Figure 2:
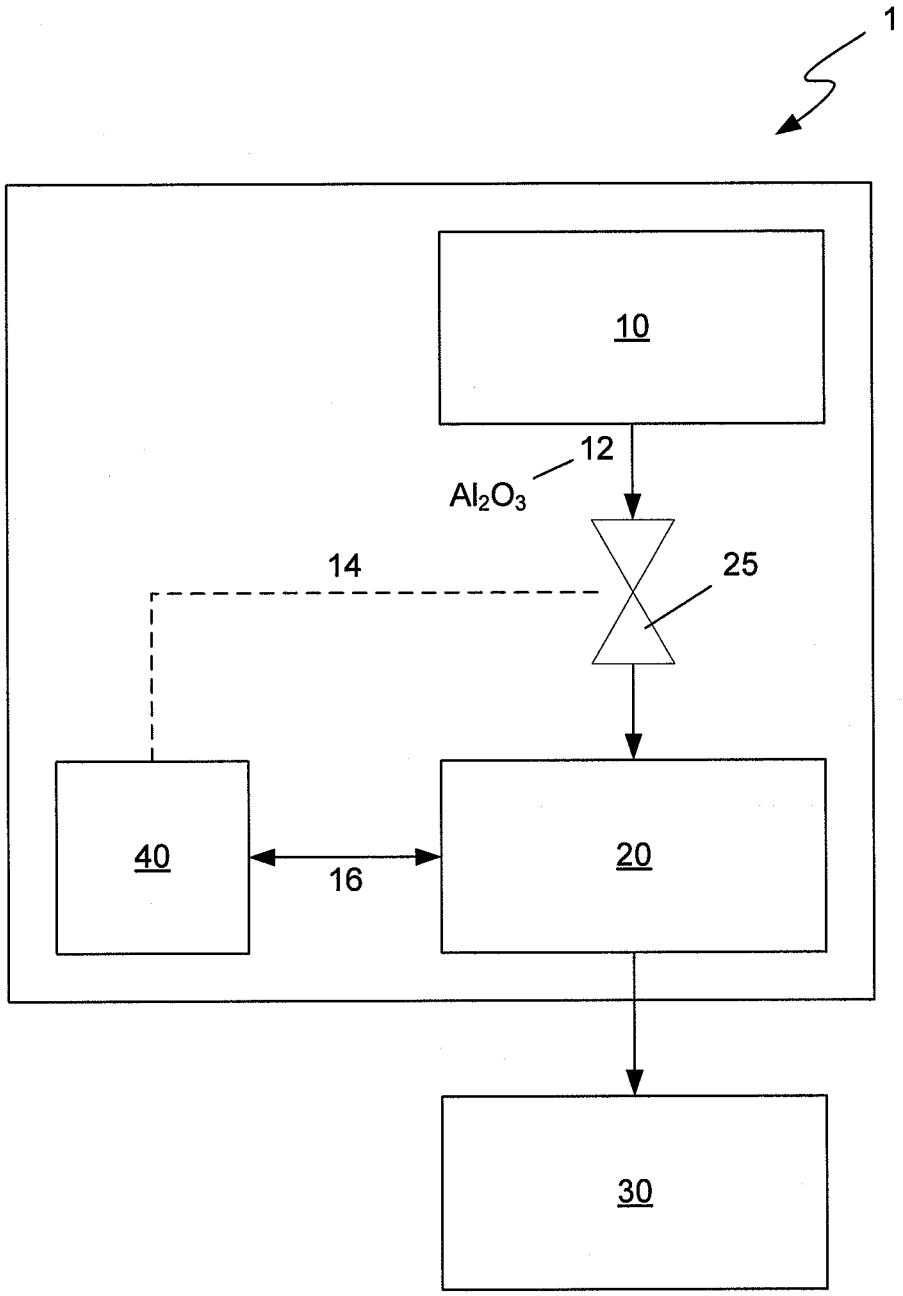
FIG. 2 is a schematic view of one embodiment of an alumina feedstock evaluation system.

Referring now to FIG. 2, one embodiment of an alumina distribution system 1 is provided, the system 1 comprising an alumina storage unit 10 comprising an alumina feedstock 12 and an alumina supply member 20. One or more aluminum electrolysis cells 30 may be in communication with the alumina distribution system 1. Particulate alumina feedstock 12 from the alumina storage unit 10 is provided to the aluminum electrolysis cell 30 via the alumina supply member 20. An alumina storage unit 10 is a container for storing and supplying alumina feedstock to an alumina supply member. An alumina feedstock 12 is a feedstock comprising particulate $Al_2O_3$. The alumina feedstock 12 (sometimes called alumina) may comprise gamma or alpha alumina, among others. In one embodiment, the alumina feedstock 12 is in particulate form and has an average particle size (D50) in the range of from about 40 μm to about 80 μm, such as in the range of from about 50 μm to about 70 μm. Alumina properties are properties of the alumina feedstock. Examples of alumina properties that may be useful in accordance with the presently described technology include particle-size distribution, feed rate and/or feed amount, among others. An alumina supply member 20 is a member comprising at least one passageway for supplying alumina feedstock to an aluminum electrolysis cell (e.g., a pipe, spout, conduit or otherwise). For example, an alumina supply member 20 may receive alumina from an alumina storage unit 10, and the alumina may flow through a passageway of the supply member 20 and into an electrolysis cell 30.

The passageway of the aluminum supply member 20 may be tortuous or non-tortuous. An aluminum electrolysis cell is a container containing an electrolyte (e.g., cryolite) through which an externally complementary electric current is passed via a system of electrodes (e.g., an anode and a cathode) in order to change the composition of a material. For example, an aluminum compound (e.g., $Al_2O_3$) may be decomposed (reduced) into pure aluminum metal (Al) via current flow in an aluminum electrolysis cell.

As shown in FIG. 2, an alumina control system 40 is provided for analyzing the alumina feedstock 12. As discussed in further detail below, the alumina control system 40 is operable to measure one or more supply member properties via the alumina supply member 20 (or other portion of the alumina supply system) and output supply member data based thereon. For example, a measurement device (e.g., a timing device, a temperature measurement device) may be utilized to obtain supply member data associated with the flow of alumina feedstock 12 through the alumina supply member 20 via connection 16. Thereafter, supply member data may be output based on the measured property/ies. The alumina control system 40 may be further operable to analyze the supply member data to evaluate the alumina feedstock 12. A supply member property is a property associated with the alumina supply member. For example, a supply member property may be at least one of flow rate, temperature, particle size, vibration, acoustic emission, and electromagnetic radiation (e.g., infrared), to name a few. Supply member data is data relating to one or more supply member properties. For example, supply member data may include flow rate data (amount and/or rate), temperature data, particle size data, vibration data, acoustic emission data, and electromagnetic radiation data (e.g., infrared data), to name a few.

In one embodiment, the alumina control system 40 is operable to adjust an operation parameter associated with the system 1 to adjust the flow of the alumina feedstock 12 to the one or more aluminum electrolysis cells 30. For example, the alumina control system 40 may be electrically interconnected to control components of the alumina storage unit 10 and/or the alumina supply member 20 (e.g., valve 25) via a wireless or wired electrical connection 14. In turn, the alumina control system 40 may adjust the feed rate of the alumina feedstock 12 via the electrical connection 14 based on the analyzed supply member data.

The alumina control system 40 may measure one or more properties via connection 16 to evaluate the alumina feedstock 12. For example, the alumina control system 40 may obtain a plurality of temperature measurement associated with the alumina supply member 20 as alumina flows through the supply member 20 to facilitate evaluation of the alumina feedstock 12. In one embodiment, one or more thermocouples are located proximal or in the alumina supply member 20 to measure the temperature of the supply member 20 as alumina passes through the supply member. The alumina feedstock 12 is generally supplied to the alumina supply member 20 on a periodic basis (i.e., non-continuous). The alumina feedstock 12 generally has a different temperature than that of the alumina supply member 20. By measuring the temperature profile of the alumina feedstock 12 during alumina feed periods, the alumina control system 40 may be able to predict the properties of the alumina feedstock (e.g., its flowability) and/or the status of the alumina supply member (e.g., status normal; status non-normal such as plugged or continuously open).

Figure 3:
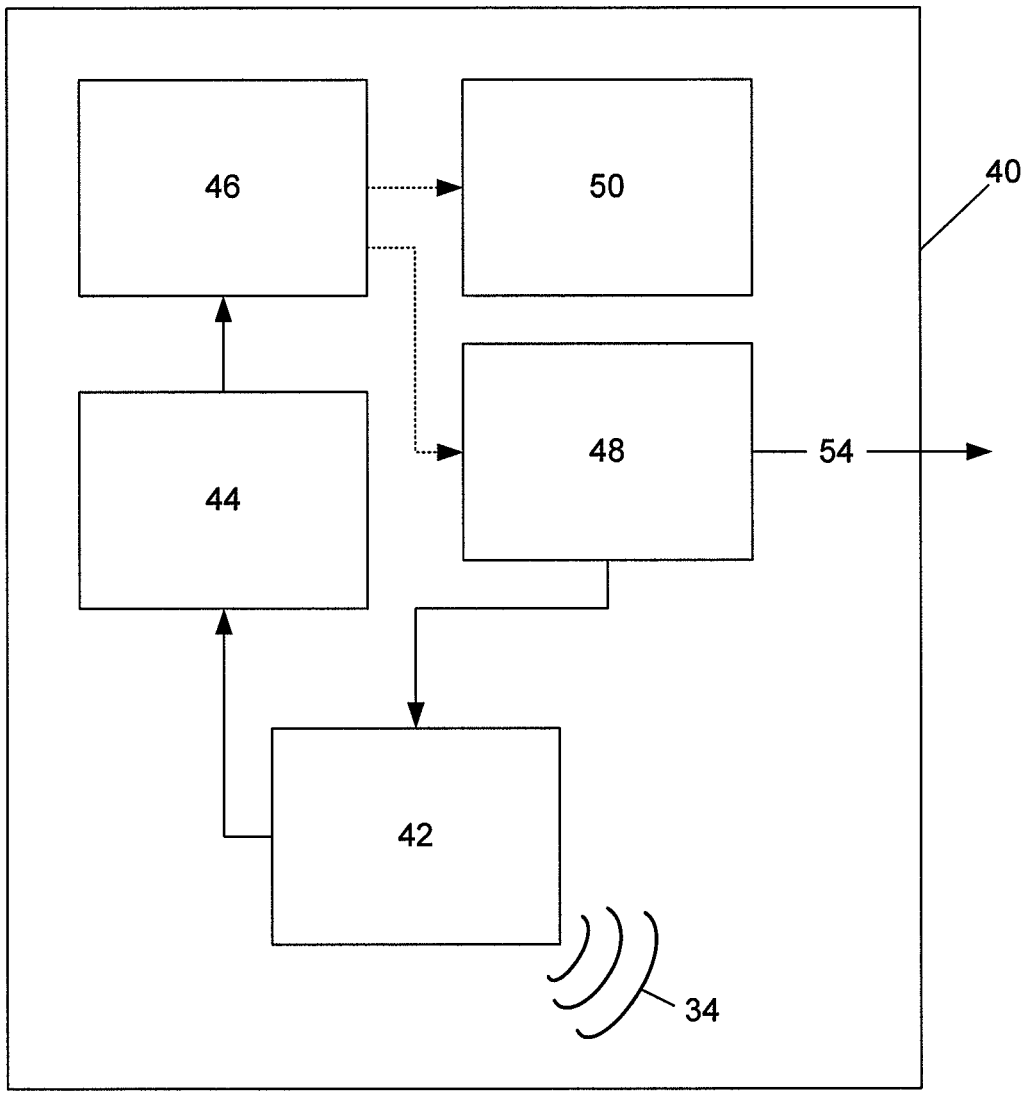
FIG. 3 is a schematic view of one embodiment of an alumina control system.

One embodiment of an alumina control system 40 is illustrated in FIG. 3. The alumina system 40 includes a measurement device 42, a processor 44, and a data analyzer 46. The alumina control system 40 may optionally include a controller 48 and/or a display 50. The measurement device 42 is operable to measure a property of the alumina supply member 20, and, in the illustrated embodiment, the measurement device 42 is interconnected to the data processor 44. The interconnection for these items, and other items, may include hard wired and/or wireless interconnections. The processor 44 is operable to process the measured properties and output supply member data. The data analyzer 46 is electrically interconnectable with the processor 44 and is operable to receive and analyze the supply member data. Thus, the alumina control system 40 is operable to obtain one or more measurements associated with the alumina supply member 20 and analyze those measurements to determine an appropriate control response (e.g., adjust a feed rate, maintain current operation parameters). In one aspect, the control response may be an automated response. In another aspect, the control response may be a manual response.

The measurement device 42 is a device capable of measuring a property (e.g., an attribute, characteristic) of the alumina supply member. For example, a measurement device may measure temperature (e.g., of the alumina as it flows through the alumina supply member 20). The measurement device 42 may also/alternatively be a device capable of measuring time, temperature, pressure, volume, area, light amount(s), and/or light wavelength(s), among others. In this regard, the measurement device 42 may be one or more of an electromagnetic sensor (e.g., a laser, a light beam, a radar, a capacitance sensor), an audio sensor (e.g., an acoustic sensor), an image capture device (e.g., a camera), a vibration sensor (e.g., a piezoelectric sensor) and a temperature sensor (e.g., a thermocouple, a thermometer), to name a few. The measurement device 42 may be located proximal the alumina supply member 20. In one embodiment, the measurement device 42 may be coupled to the alumina supply member. For example, the measurement device 42 may be bonded to the alumina supply member 20 (e.g., melted, welded, adhesively connected). In one embodiment, the measurement device 42 may be in direct communication with a passageway of the alumina supply member 20 (e.g., via a hole). In other embodiments, the measurement device 42 may be located remote of the alumina supply member 20. For example, the measurement device 42 may measure a property (e.g., electromagnetic, acoustic) remote of the alumina supply member 20, such as by electromagnetic radiation 34.

The processor 44 is a computerized device capable of processing signals (e.g., carry out operations on and/or measurements on) for outputting supply member data. The processor 44 is operable to process the measurements of the measurement device 42 and output supply member data based thereon (e.g., binary data). The processor 44 may be a device separate from the measurement device 42, or the processor 44 may be included with the measurement device 42. For example, a processor 44 of a general purpose computer may receive and process a signal from the measurement device 42, and may output supply member data. In other embodiments, the processor 44 is a programmable logic controller (PLC). Other arrangements may be used.

The data analyzer 46 is operable to analyze supply member data and provide an output relating to alumina properties of the alumina feedstock 12, the alumina storage unit 10 and/or the alumina supply member 20 (e.g., a predicted property of the alumina and/or a status of the alumina supply member). The data analyzer 46 is electrically interconnectable to the processor 44 and is operable to analyze the supply member data to facilitate approximation of alumina feedstock properties and/or determination of an appropriate control response.

For example a digital interface, such as a IEEE-1394 compliant digital interface may be used to electrically interconnect the data analyzer 46 to the processor 44 and/or the measurement device 42. The data analyzer 46 may be, for example, a computerized device, such as a general purpose computer comprising hardware and software that enables the computerized device to receive the supply member data and perform calculations based thereon. Upon receipt of the supply member data, the data analyzer 46 may analyze supply member data to facilitate evaluation of the alumina feedstock 12 (e.g., approximation of the properties of the alumina feedstock) and/or determination of the appropriate control response. In one embodiment, the data analyzer 46 may analyze supply member data for a plurality of alumina feedstock feeding periods to facilitate evaluation of the alumina feedstock 12 and/or determination of the appropriate control response.

The data analyzer 46 may analyze the supply member data to facilitate evaluation of the alumina feedstock 12 and/or the status of the alumina supply member. In one embodiment, various one(s) of the supply member data are correlated to form one or more alumina prediction model(s) and/or to output one or more predicted alumina parameter(s). The alumina prediction model may be a model that employs supply member data to evaluate the alumina feedstock. In one embodiment, the alumina prediction model uses supply member data to output one or more predicted alumina parameter(s). In one embodiment, supply member data are correlated to form the alumina prediction model and/or output the predicted alumina parameter(s). The data analyzer 46 may thus utilize supply member data to evaluate the alumina feedstock and output a predicted alumina parameter (e.g., a physical characteristic of the alumina; the status of the alumina supply member). In one embodiment, the predicted alumina parameter is a predicted flowability of the alumina feedstock. In other embodiments, the predicted alumina parameter is one or more of alumina particle size distribution ((D10, D50, D99, etc.) alumina feed rate and/or alumina feed amount, among others. In turn, the predicted alumina parameter(s) may be evaluated to determine whether a processing parameter (e.g., alumina flow rate) should be modified, for example, by comparing the predicted physical properties of the alumina feedstock, as obtained from the alumina prediction model, to standard (e.g., average) physical properties of an alumina feedstock.

An alumina prediction model is a model that uses supply member data and outputs one or more predicted alumina parameters. The alumina prediction model may utilize current and/or historical supply member data and/or other data to develop a model that may utilize current or future supply member data to evaluate an alumina feedstock (e.g., to predict one or more physical properties of the alumina feedstock). In one embodiment, the alumina prediction model is developed using one or more of partitioning, ordinary or stepwise regression, partial least squares regression, neural networks non-linear regression, and response-surface modeling statistical analysis techniques, among others. In one embodiment, the alumina prediction model utilizes a plurality of the supply member data and other data to develop and/or maintain the model. The supply member data may be used to develop and/or maintain the model and the other data may be used to develop, maintain and/or verify the model. For example, supply member data may be correlated to develop a prediction tool for predicting a physical property of the alumina. The other data may be used to verify whether the prediction tool is sufficiently accurate. In one embodiment, the other data is data associated with the alumina feedstock. For example, physical measurements of the alumina feedstock may be utilized as the other data in the alumina prediction model. Hence, the alumina prediction model utilizes at least some supply member data to provide a model that facilitates evaluation of the alumina feedstock.

Utilizing the alumina prediction model, the data analyzer 46 may utilize supply member data to output one or more predicted alumina parameter. The predicted alumina parameters may be properties relating to the alumina feedstock, such as properties relating to alumina flowability and/or alumina particle size distribution, among others. For example, the alumina properties may be alumina flowability. In another instance, the alumina properties may be related to the alumina particle size distribution. In yet another instance, the alumina properties may be an alumina feed rate and/or feed amount. Predicted alumina parameters may alternatively or additionally relate to the properties or status of the alumina supply member. For example, a predicted alumina parameter may be that the status of the alumina supply member is normal. A predicted alumina parameter may be that the status of the alumina supply member is non-normal, such as plugged or continuously open, among others.

In one embodiment, the data analyzer 46 may receive supply member data and may utilize this supply member data in conjunction with the alumina prediction model to output one or more predicted alumina parameters, such as alumina flowability, alumina particle size distribution, or other suitable alumina properties. In a particular embodiment, the data analyzer calculates an alumina flowability based on supply member data utilizing an alumina prediction model. In this embodiment, an alumina prediction model may be formed by utilizing the following formula:

$$a0+a(1)*f1+a(2)*f(2)+\ldots a(n)*f(n)$$

where n is the number of linear terms used in the model, which may be determined by application of a statistical regression technique to the supply member dataset(s), where a0=an intercept, where a(1), a(2) . . . a(n) are regression coefficients estimated by from statistical regression, and where f(1), f(2) . . . f(n) are statistical summaries of one or more supply member characteristic data. In one embodiment, the statistical summary includes, in no particular order, at least one of the following statistics for at least one of the supply member data:

- Mean
- Median
- Standard deviation
- Range
- Coefficient of variation (standard deviation/mean)
- 1st quartile (i.e., 25% quantile, the value that exceeds 25% of all values)
- 3rd quartile (i.e., 75% quantile)
- 1st derivative of the measured data
- 2nd derivative of the measured data
- Coefficients from a polynomial fit of the measured data Once developed, the alumina prediction model may be utilized with new or additional supply member data to evaluate one or more alumina feedstocks. In one embodiment, the data analyzer 46 uses the supply member data with the alumina prediction model to predict alumina flowability. The data analyzer 46 may compare the predicted alumina flowability to a desired alumina flowability. For example, an aluminum electrolysis cell may require an alumina flow rate of at least about 1.5 g/sec (e.g., at least about 50, 100, 150, 200, or 250 g/sec). If the predicted alumina flowability obtained from the supply member data and alumina prediction model is at or above the target flow rate, no changes may be needed with respect to the supply of alumina feedstock to the aluminum electrolysis cells. If the predicted alumina flowability is outside of the target flow rate, an operation parameter may be adjusted. The alumina prediction model may be static or may be dynamically adjusted based on received supply member data and/or other data.

The output predicted alumina property/ies may be utilized in a variety of ways. For example, the predicted alumina property/ies may be provided to the controller 48 for use in controlling the supply of alumina feedstock to one or more aluminum electrolysis cells. The controller 48 may be interconnectable with at least the data analyzer 46 and operable to output control parameters to control the supply of alumina feedstock. For example, the controller 48 may send signals (e.g., via connection 54) to the alumina storage unit 10 and/or the alumina supply member 20, or components associated therewith (e.g., valve(s), such as valve 25) to facilitate an appropriate adjustment of the feed rate of those sources based on received alumina prediction parameters. The controller 48 may be, for example, a computerized device operable to send signals to one or more of the alumina storage unit 10, the alumina supply member 20, and/or a measurement device 42. The controller 48 and data analyzer 46 may be integrated in a single computerized device, or may be separate units.

The alumina control system 40 may be related to a single aluminum electrolysis cell or a plurality of aluminum electrolysis cells. In one embodiment, the alumina control system 40 is associated with a control room, where the operation parameters of one or more aluminum electrolysis cells may be adjusted based on the predicted alumina parameter(s). For example, variance in high alumina flowability indicates that alumina dissolution rates may also vary. The type and/or amount of alumina feedstock supplied may be adjusted accordingly so as to facilitate increased performance of such aluminum electrolysis cells. In turn, less emissions and/or higher aluminum metal production rates may be realized.

In another approach, the predicted alumina property/ies, supply member data and/or a suggested control response may be displayed via a display 50, which may be electrically interconnected to the data analyzer 46. In one embodiment, a sensory indication (e.g., a visual, audible, and/or olfactory indication) may be provided by an alumina control system 40 to alert an operator with respect to the operating conditions of an alumina supply system. For example, an audible alarm, a light, or other indicator may be triggered if the predicted alumina parameter(s) and/or supply member data indicates that the physical properties of the alumina feedstock and/or the alumina feedrate to the aluminum electrolysis cells may be outside of tolerable production limits/ranges. In one embodiment, an operator may view one or more of the predicted alumina property/ies, supply member data and/or a suggested control response via the display 50 and then take appropriate action. For example, if an alumina storage unit 10 and/or alumina supply member 20 has a flow rate that is too high (a supply valve is broken), or too low (e.g., clogged), the operator may take appropriate action. In these embodiments, the data analyzer and/or a model may not be required since an alarm may be triggered simply by the supply member data itself being outside of a predetermined target. For example, when the alumina supply member has a flow rate that is too high due to a broken valve, the temperature may be measured to be continuously low. When the alumina supply member has a flow rate that is too low due to clogging, the temperature may be measured to be continuously high.

As shown in FIG. 2, an alumina supply member 20 is used to provide alumina feedstock 12 from the alumina storage unit 10 to the one or more aluminum electrolysis cells 30. The alumina supply member 20 may be in any suitable arrangement that facilitates conveyance of the alumina feedstock 12 while also enabling capture of supply member data. In one embodiment, the alumina supply member 20 is configured to achieve a predetermined residence time of the alumina feedstock relative to the alumina supply member 20. In one embodiment, a predetermined residence time is at least about 1 or 2 seconds. In other embodiments, the predetermined residence time is not greater than about 30 seconds. In other embodiments, the predetermined residence time is not greater than about 25, 20, 15, 10, or 5 seconds. In other embodiments, the predetermined residence time is in the range of from about 2 or 2.5 seconds to about 4, 1.5, or 5 seconds. By achieving a predetermined residence time, measurement of supply member properties and/or determination of predicted alumina parameter(s) may be facilitated. For example, when an alumina feedstock flows through the alumina supply member 20, a temperature decrease may be realized. With sufficient residence time, an adequate amount of temperature measurements may be achieved, and thus an adequate amount of supply member data may be output. In turn, the data analyzer may be able to more accurately and/or precisely determine predicted alumina parameter(s). Furthermore, by limiting residence time, impact of alumina flow rate and/or aluminum production conditions may be restricted and/or minimized.

Figure 4A:
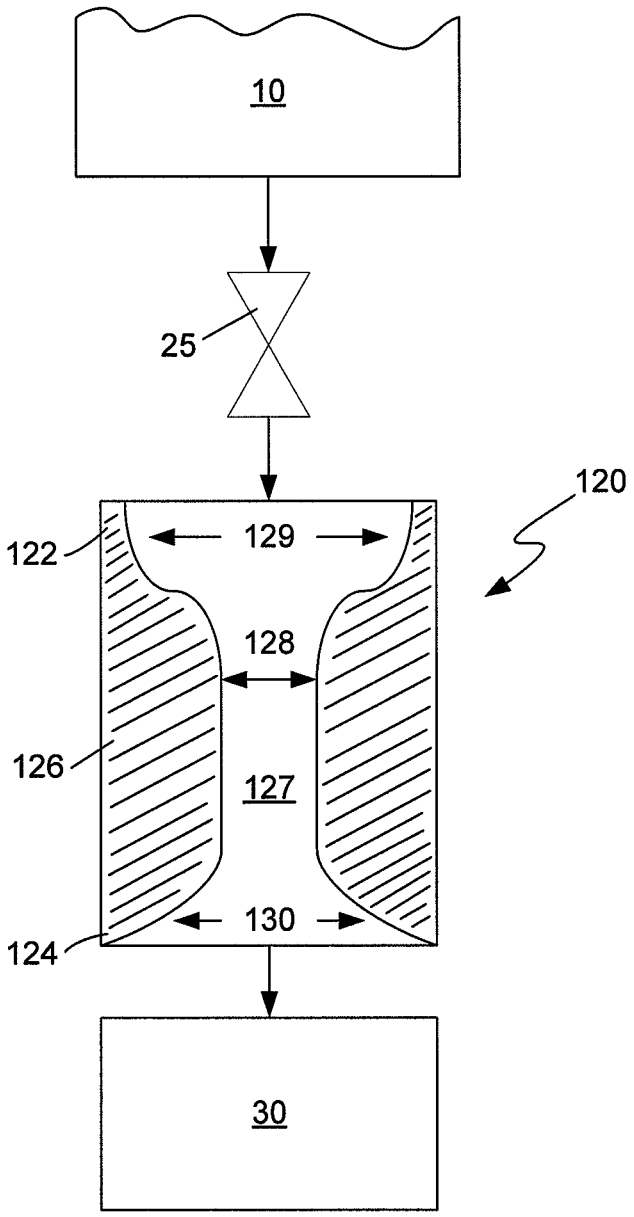
FIG. 4*a* is schematic view of one embodiment of an alumina supply member of an aluminum feedstock evaluation system.

One embodiment of an aluminum supply member is illustrated in FIG. 4*a*. In the illustrated embodiment, the alumina supply member 120 includes a distal end portion 122, a proximal end portion 124, and a middle portion 126 disposed between the distal end portion 122 and the proximal end portion 124. The supply member 120 includes a passageway 127 having a first diameter 128 and a second diameter 129, and a third diameter 130, each associated with its respective portion of the alumina supply member 120. In the illustrated embodiment, the distal end of the passageway 127 is in communication with the alumina storage unit 10 (e.g., via valve 25) and the proximal end of the passageway is in communication with at least one aluminum electrolysis cell 30 (e.g., a bath of an aluminum electrolysis cell 30). In the illustrated embodiment, the first diameter 128 is smaller than the second diameter 129 so as to facilitate achievement of the predetermined residence time. That is, the first diameter 128 is appropriately sized so as to achieve the predetermined residence time range.

The size of the first diameter 128 is generally dependent on the type of alumina used, but is generally less than the second diameter 129. In one embodiment, the second diameter 129 has a size that is coincidental to the outlet diameter (not shown) of the alumina storage unit 10. In one embodiment, the second diameter 129 is about 52 mm. In these embodiments, the first diameter 128 is generally less than about 50 mm. In one embodiment, the first diameter 128 is at least about 5 mm. In other embodiments, the first diameter 128 is at least about 8 mm, or at least about 10 mm, or at least about 12 mm, or at least about 14 mm, or at least about 16 mm, or at least about 18 mm, or at least about 20 mm. In one embodiment, the first diameter 128 is not greater than about 48 mm. In other embodiments, the first diameter 128 is not greater than about 46 mm, or not greater than about 44 mm, or not greater than about 42 mm, or not greater than about 40 mm, or not greater than about 38 mm, or not greater than about 36 mm, or not greater than about 34 mm, or not greater than about 32 mm, or not greater than about 30 mm. In one embodiment, the first diameter 128 is in the range of from about 5 mm to about 50 mm. In other embodiments, the first diameter 128 is in the range of from about 10 mm to about 40 mm, or about 15 mm to about 35 mm, or about 20 mm to about 30 mm.

The third diameter 130 may be coincidental in size or larger than the first diameter 128. In other embodiments (not illustrated), the first diameter 128 is larger than one or more of the second diameter 129 or the third diameter 130. Other manners of tailoring residence time may be employed. For example, a plug or other flow restricting devices, apparatus or systems may be utilized relative to the alumina supply member to achieve suitable alumina feedstock residence times.

Figure 4B:
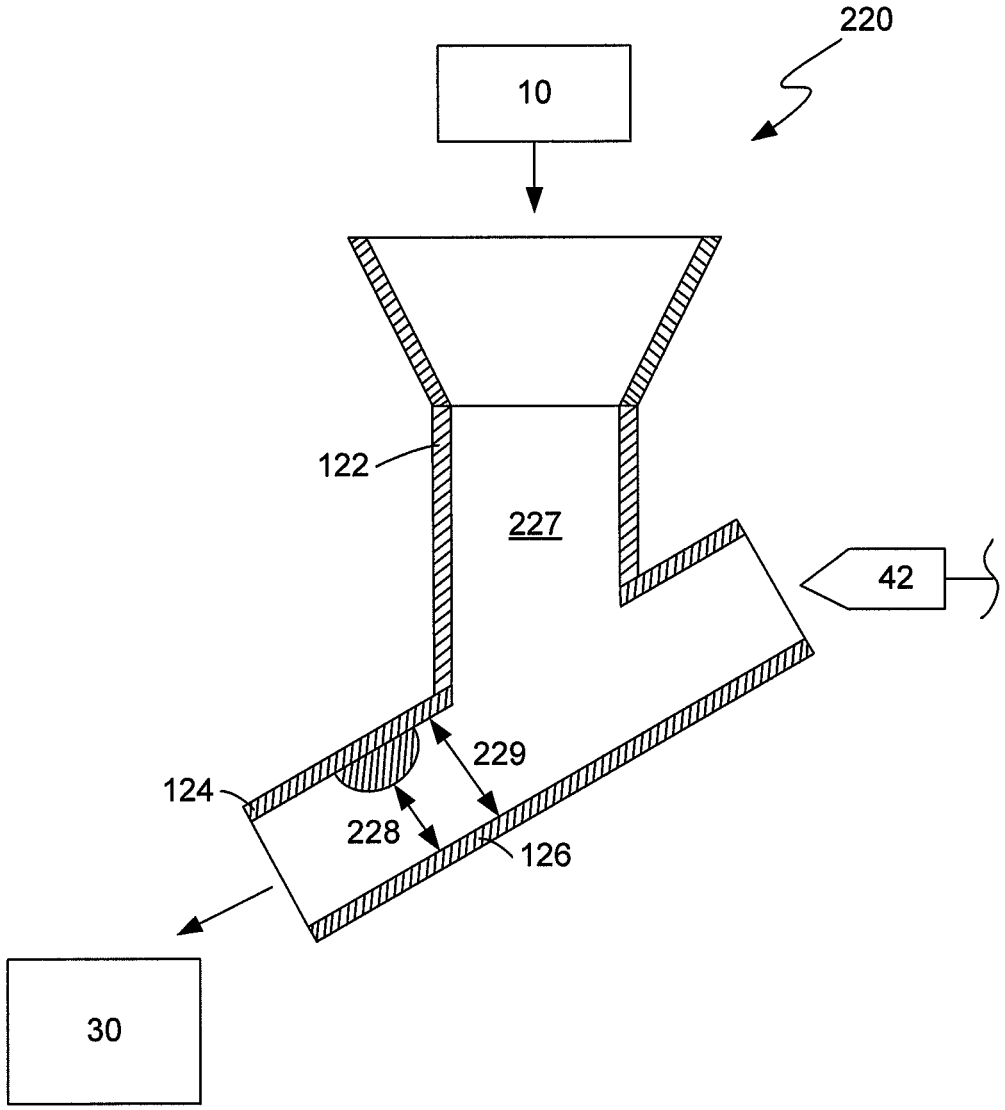
FIG. 4*b* is schematic view of another embodiment of an alumina supply member of an aluminum feedstock evaluation system.

FIG. 4*b* illustrates another embodiment of an alumina supply member 220. In this embodiment, a passageway 227 of the alumina supply member 220 is tortuous. The middle portion 126 of the passageway 227 of the alumina supply member 220 includes the first diameter 228 and the second diameter 229. A measurement device 42, in this case a timing device (e.g., a laser), measures the amount of time it takes for the alumina feedstock to flow through the middle portion 126 for each alumina supply period. This supply member data (flow time) may be supplied to the data analyzer 46, which may output predicted alumina parameters (e.g., anticipated alumina dissolution rate) based on the flow time.

Figure 5:
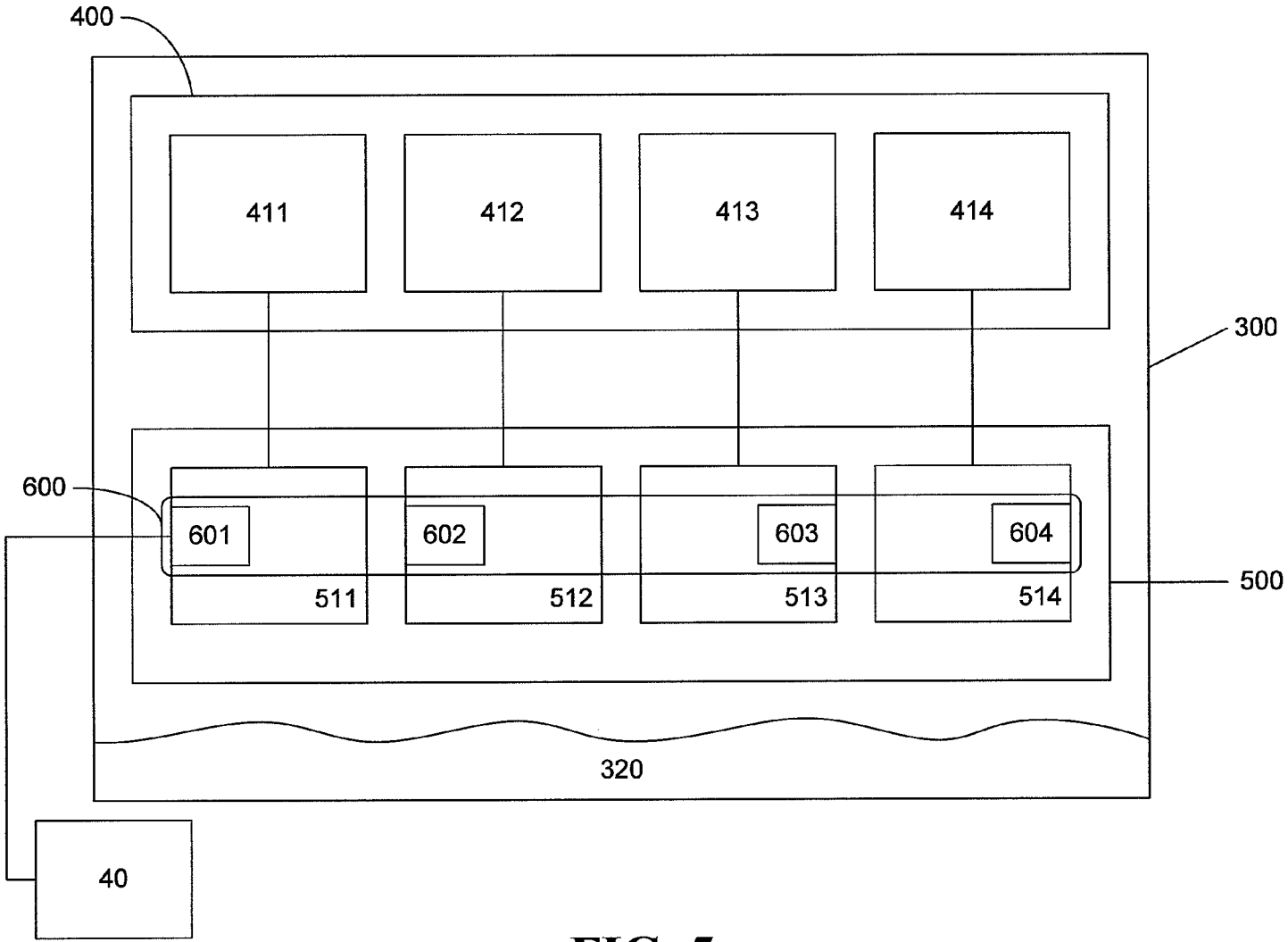
FIG. 5 is a schematic view of another embodiment of an alumina feedstock evaluation system.

Referring back to FIG. 2, the illustrated embodiments of FIG. 2 show the alumina storage unit 10 and the alumina supply member 20 to be remote of the aluminum electrolysis cells. In other embodiments, one or more alumina storage units 10 and/or one or more the alumina supply members 20 may be located proximal or even contained within an aluminum electrolysis cell 30. For example, and as illustrated in FIG. 5, an aluminum electrolysis cell 300 includes a plurality of alumina storage units 400, in this case bins 411-414, alumina supply members 500, in this case feeder pipes 511-514, and measurement devices 600, in this case thermocouples 601-604. The bins 411-414 may be mounted within the cell superstructure (not illustrated). The bins 411-414 contain alumina feedstock 12 for feeding to a molten bath 320 of the aluminum electrolysis cell 300. The proximal end portions of the feeder pipes 511-514 are located above the surface of the molten bath 320. Periodically, alumina feedstock 12 of the bins 411-414 may be supplied to the bath 320 via the corresponding feeder pipes 511-514 (e.g., 1-2 kilograms per supply period). For instance, a valve associated with bin 411 may be opened (e.g., via an alumina control system—not illustrated), and alumina feedstock of bin 411 may flow through corresponding feeder pipe 511 and into the molten bath 320. Concomitantly, measurement device 601 may measure a supply member property (e.g., temperature of the alumina feedstock). As described above, a processor may convert the measured properties into supply member data, and a data analyzer may analyze the supply member data and output a predicted alumina property for the alumina feedstock 12 associated with bin 411. Similar methodologies may be employed with bins 412-414 and their corresponding feeder pipes 512-514 and measurement devices 612-614

The alumina storage units and/or alumina supply members may distribute alumina at the same time, or the alumina storage units and/or alumina supply members may distribute alumina at a different time periods. In any event, each alumina storage unit and/or alumina supply member of an aluminum electrolysis cell may be separately controlled via an alumina control system. Likewise, one or more alumina storage units and/or one or more corresponding alumina supply members may be jointly controlled via an alumina control system. Thus, tailored supply rates and/or amounts and/or types of alumina within various portions of the aluminum electrolysis cell 300 may be realized/achieved.

Figure 6:
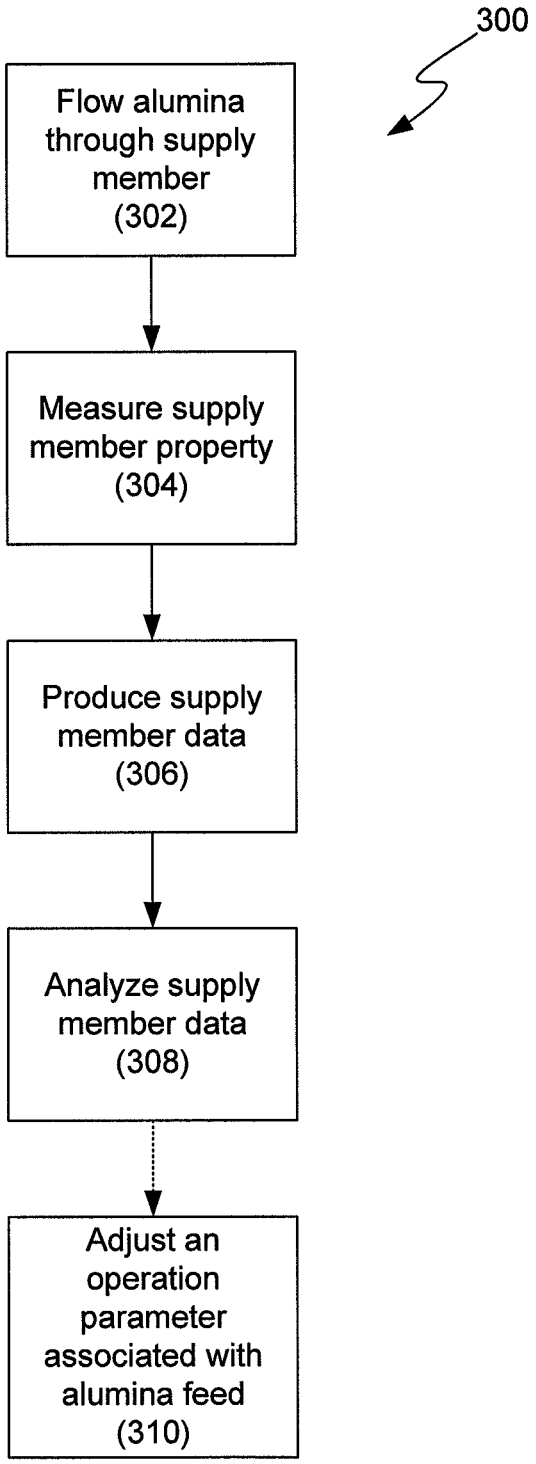
FIG. 6 is a flow chart illustrating one embodiment of a method of evaluating an alumina feedstock.

Methods of supplying alumina feedstock to an aluminum electrolysis cell are also provided, one embodiment of which is illustrated in FIG. 6. In the illustrated embodiment, the method 300 includes the step of flowing an alumina feedstock through an alumina supply member (302). The alumina supply member may be in communication with an aluminum electrolysis cell. The method may further include the steps of measuring at least one supply member property (304), such as concomitant to the flowing step (302), producing supply member data based on the supply member property (306), and analyzing the supply member property (308), thereby determining one or more predicted alumina parameters. In response, the method may include adjusting an operation parameter associated with the flow of the alumina feedstock (310).

The measure supply member property step (304) measures the property of a supply member (e.g., the temperature of alumina feedstock flowing therethrough). Various measurements can be completed, as described above. The producing supply member data step 306 may be accomplished via, for example, processor that outputs supply member data (e.g., temperature data) based on the measured property/ies. In one embodiment, the data may be in a binary data format (e.g., when a processor is integrated with a measurement device), and the binary data may be supplied (e.g., via electrical communication) to a data analyzer.

Figure 7:
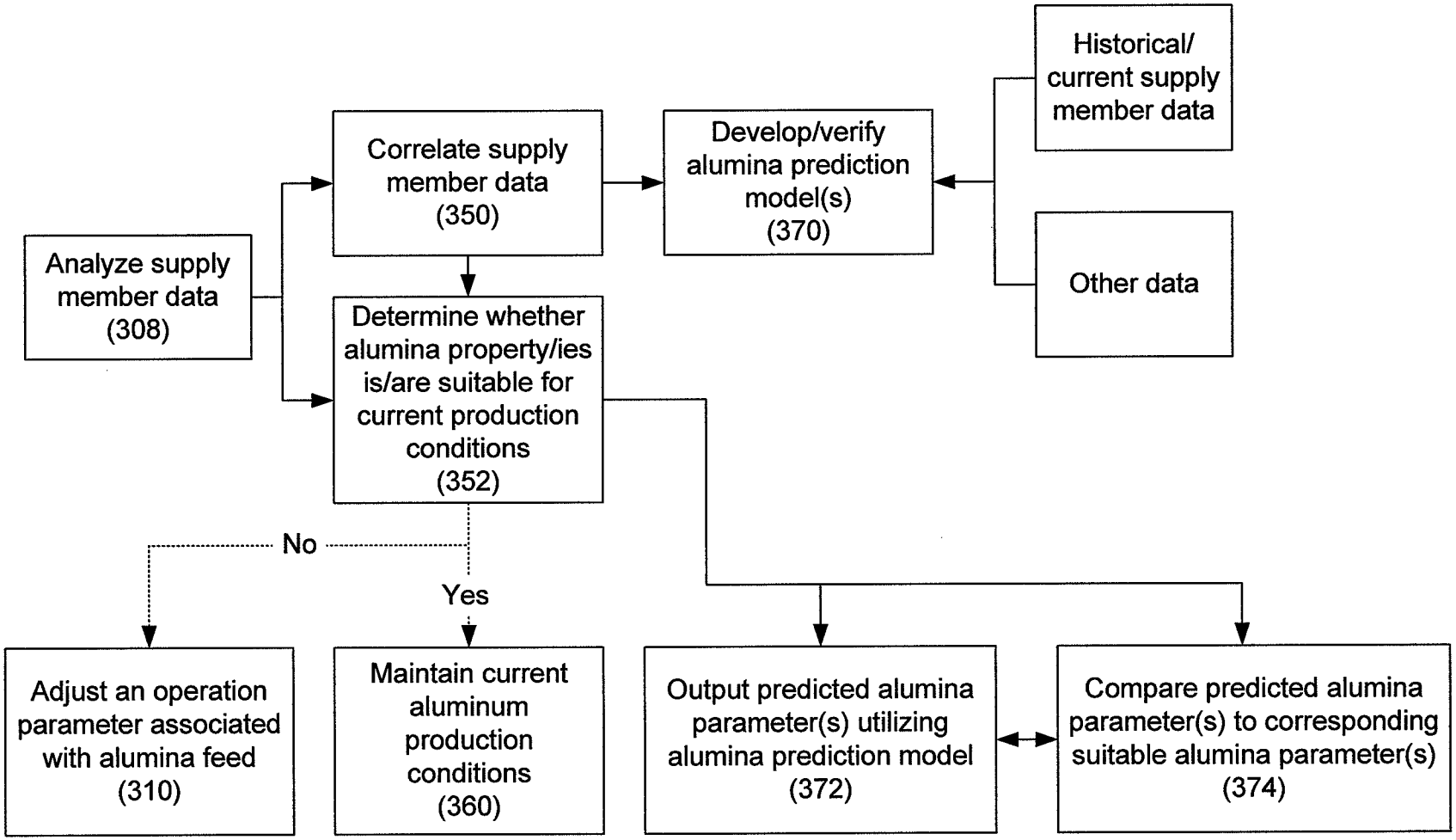
FIG. 7 is a flow chart illustrating one embodiment of the analyzing step of FIG. 6.

Referring now to FIGS. 6 and 7, the analyzing supply member data step 308 may be accomplished via any suitable technology, such as a computerized device (e.g., a general purpose computer). The supply member data may be analyzed to evaluate the alumina feedstock 12 and/or assess whether an operation parameter associated with the aluminum production should be adjusted. For example, at least some of the supply member data may be correlated 350 to facilitate determination of whether the alumina feedstock 12 is suitable for current aluminum production conditions 352. In a particular embodiment, an alumina prediction model may be developed 370 based, at least in part, on supply member data, whether historical or current. In one embodiment, other data, such as physical properties data associated with the alumina feed materials, may be utilized to assist in developing, maintaining and/or verifying the alumina prediction model. To evaluate the alumina feedstock, supply member data may be input into the alumina prediction model, and one or more alumina prediction parameter(s) may be output 372. In turn, the predicted alumina parameter(s) may be compared to suitable alumina parameter(s) to evaluate the alumina feedstock and/or determine whether the alumina is suitable 374. For example, alumina flowability may be output as the predicted alumina parameter and this alumina flowability may be compared to a known suitable alumina flowability. If the predicted alumina flowability meets one or more predetermined criteria, the alumina feedstock, alumina flow rate, and/or electrolysis cell operation parameters, among others, may be determined to be suitable. Likewise, if the predicted alumina flowability does not meet one or more predetermined criteria, one or more of such items may be determined to be unsuitable. Other alumina prediction parameters may also/alternatively be employed. In one embodiment, a plurality of predicted alumina parameters are utilized, and a hierarchical/weighing methodology is employed to accord various prediction parameters differing degrees of importance when evaluating the alumina feedstock.

If the analysis step 308 suggests that the alumina feedstock is suitable (e.g., suitable for maintaining or improving the efficiency of the aluminum electrolysis cell), current aluminum production conditions may be maintained 360. If the analysis step 308 suggests that the alumina feedstock and/or flow rate, among others, is unsuitable or may soon become unsuitable, one or more operation parameters associated with the production of the aluminum metal production may be adjusted 310. For example, the amount or type of alumina fed to the aluminum electrolysis cell may be adjusted 312. The measure supply member property 304, produce supply member data 306 and analyze supply member data 308 steps may be repeated, as necessary, to facilitate evaluation of alumina feedstock and production of aluminum metal in the aluminum electrolysis cells.

EXAMPLES

Example 1

Determination of Alumina Flowability

An alumina feedstock is flowed through an alumina supply member having a first diameter and a second diameter. The first diameter is varied using a series of plugs having diameters in the range of from about 12.8 to about 50.8 mm (i.e., no plug). The second diameter is 50.8 mm. Thermocouples are used to measure the temperature profile of the alumina feedstock as the alumina feedstock flows through the alumina supply member at the various first diameters. The average time it takes for the alumina feedstock to flow through the alumina supply member (the alumina flow funnel time) is also measured manually via a timer. Based on these measurements, an alumina prediction model is developed using partial least squares regression, correlating the temperature profile of the alumina supply member to the flow funnel time. A regression analysis indicates that the model is accurate. The explained variance between actual flow funnel time and predicted flow funnel time is between about 0.74 and about 0.98, indicating that using temperature measurements associated with the alumina feedstock flowing through an alumina supply member is a reliable method for approximating one or more properties of an alumina feedstock. First diameters in the range of 20 to 30 mm prove accurate in predicting alumina properties based on temperature measurements.

While the present technology has generally been described in relation to evaluation of a an alumina feedstock in an aluminum electrolysis cell environment, the teachings provided herein may also be applied to other alumina feed systems. Moreover, while various embodiments of the present technology have been described in detail, it is apparent that modifications and adaptations of those embodiments will occur to those skilled in the art. However, it is to be expressly understood that such modifications and adaptations are within the spirit and scope of the present described technology.

What is claimed is:

1. A system comprising:

(a) an alumina storage unit comprising an alumina feedstock;

(b) an alumina supply member in communication with the alumina storage unit and an aluminum electrolysis cell containing an electrolyte, wherein the alumina feedstock of the alumina storage unit periodically flows through the alumina supply member and into the electrolyte in the aluminum electrolysis cell; and (c) a measurement device in communication with the alumina supply member, wherein the measurement device is configured to measure a supply member property indicative of a property of the alumina feedstock passing through the supply member prior to discharge of the feedstock into the electrolyte and transmit a first signal to a processor, wherein the processor is configured to receive the first signal and produce supply member property data based, at least in part, on the first signal.

2. The system of claim 1, further comprising:

a data analyzer configured to analyze the supply member property data and provide a predicted alumina property based on the supply member property data.

3. The system of claim 2, wherein the predicted alumina property comprise at least one of alumina flowability and alumina particle size distribution.

4. The system of claim 2, further comprising:

an alumina flow control device in communication with at least one of the alumina storage unit and the alumina supply member;

a controller in communication with the alumina flow control device;

wherein the controller adjusts the alumina flow control device, based at least in part, on the predicted alumina property.

5. The system of claim 1, wherein the alumina supply member comprises a passageway having a distal end portion, a proximal end portion and a middle portion;

wherein the distal end portion in communication with the alumina storage unit;

wherein the proximal end portion in communication with the aluminum electrolysis cell; and wherein the middle portion is disposed between the distal end portion and the proximal end portion, wherein the middle portion comprises a first diameter, and wherein the distal end portion comprises a second diameter.

6. The system of claim 5, wherein the first diameter is smaller than the second diameter.

7. The system of claim 6, wherein the first diameter is sized to achieve a predetermined residence time range relative to the alumina feedstock.

8. The system of claim 7, wherein the measurement device is in communication with the passageway of the alumina supply member.

9. The system of claim 7, wherein the first diameter has a size in the range of from about 5 mm to about 50 mm.

10. The system of claim 9, wherein the first diameter has a size in the range of from about 10 to about 40 mm.

11. The system of claim 9, wherein the first diameter has a size in the range of from about 15 to about 30 mm.

12. The system of claim 7, wherein the predetermined residence time range is from about 1 to about 30 seconds.

13. A method comprising:

(a) flowing alumina feedstock through an alumina supply member, wherein the alumina supply member is in communication with an aluminum electrolysis cell containing electrolyte, the alumina feedstock discharging into the electrolyte after flowing through the alumina supply member;

(b) concomitant to the flowing step and prior to discharge of any given portion of the feedstock into the electrolyte, measuring at least one supply member property indicative of a property of the given portion of feedstock flowing through the alumina supply member;

(c) producing supply member data based on the supply member property; and (d) analyzing the supply member property, thereby determining characteristics of the given portion of alumina feedstock.

14. The method of claim 13, further comprising:

adjusting an operation parameter associated with the flow of the alumina feedstock.

15. The method of claim 13, wherein the characteristic of the alumina feedstock is alumina flowability.

16. The method of claim 13, wherein the measuring comprises taking a plurality of temperature measurements associated with the alumina supply member.

17. The method of claim 13, wherein the analyzing step comprises:

comparing the supply member data to historical operational data.

18. The method of claim 17, further comprising:

adjusting an operation parameter associated with the flow of the alumina feedstock in response to the comparing step.

19. The method of claim 13, wherein the analyzing step comprises:

developing an alumina prediction model based at least in part on the supply member data; and outputting at least one predicted alumina property utilizing the alumina prediction model.

20. A method comprising:

(a) flowing alumina feedstock through an alumina supply member, wherein the alumina supply member is in communication with an aluminum electrolysis cell containing an electrolyte, the alumina feedstock discharging into the electrolyte after flowing through the alumina supply member;

(b) measuring at least one supply member property indicative of a property of the alumina feedstock while the alumina feedstock is present in the alumina supply member and before the alumina feedstock is discharged into the electrolyte;

(c) producing supply member data based on the supply member property; and (d) determining whether an alumina flow rate is too high or too low.

* * * * *